US006809479B2

(12) United States Patent
Shimomura et al.

(10) Patent No.: US 6,809,479 B2
(45) Date of Patent: Oct. 26, 2004

(54) SELF-BALLASTED ELECTRODELESS DISCHARGE LAMP AND ELECTRODELESS DISCHARGE LAMP OPERATING DEVICE

(75) Inventors: Yoko Shimomura, Nara (JP); Koji Miyazaki, Osaka (JP); Satoshi Kominami, Osaka (JP); Kohei Enchi, Osaka (JP); Hiroyuki Uchiyama, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/265,047

(22) Filed: Oct. 4, 2002

(65) Prior Publication Data

US 2003/0071583 A1 Apr. 17, 2003

(30) Foreign Application Priority Data

Oct. 12, 2001 (JP) ..... 2001-314877

(51) Int. Cl.[7] ..... H05B 41/16

(52) U.S. Cl. ..... 315/39; 315/248; 313/485; 313/493

(58) Field of Search ..... 315/248, 39; 313/493, 313/485

(56) References Cited

U.S. PATENT DOCUMENTS 4,010,400 A * 3/1977 Hollister ..... 315/248

FOREIGN PATENT DOCUMENTS

| | | |
|---|---|---|
| JP | 58-57254 | 4/1983 |
| JP | 10199483 A | 7/1998 |

* cited by examiner

*Primary Examiner*—David Vu
(74) *Attorney, Agent, or Firm*—Harness, Dickey & Pierce, P.L.C.

(57) ABSTRACT

A self-ballasted electrodeless discharge lamp of the invention is provided with a discharge vessel filled with discharge gas, the discharge vessel having a cavity portion, a coil inserted into the cavity portion of the discharge vessel, a ballast circuit for supplying high frequency power to the coil, and a lamp base that is electrically connected to the ballast circuit, wherein the discharge vessel, the coil, the ballast circuit, and the lamp base are configured as a single unit, and a reflective tape for reflecting light that is radiated from the discharge gas and emitted from inside the discharge vessel to its cavity portion side is wound around the coil.

12 Claims, 5 Drawing Sheets

SELF-BALLASTED ELECTRODELESS DISCHARGE LAMP AND ELECTRODELESS DISCHARGE LAMP OPERATING DEVICE

BACKGROUND OF THE INVENTION

The present invention relates to self-ballasted electrodeless discharge lamps and electrodeless discharge lamp operating devices.

With conventional electrodeless discharge lamps, high frequency alternating current is supplied through a coil to generate an alternating magnetic field from the coil and form a plasma within the discharge vessel. Then, ultraviolet light radiated from the plasma is converted into visible light by a phosphor layer that has been applied to the inside surface of the discharge vessel, and light emanates to the outside. An electrodeless discharge lamp of this configuration is disclosed in JP S58-57254A, for example.

However, a problem with this conventional configuration was that the efficiency is much lower than that of discharge lamps with electrodes already in general circulation.

Accordingly, in recent years, electrodeless discharge lamps in which a reflective coating is formed on a portion of the discharge vessel so as to increase the usage efficiency of the generated light have been developed. Such an electrodeless discharge lamp is disclosed in JP H10-199483A, for example. The configuration of a conventional electrodeless discharge lamp having a reflective coating is described below.

FIG. 3 shows the configuration of a conventional electrodeless discharge lamp having a reflective coating. In FIG. 3, mercury and a rare gas are filled into a discharge vessel 21 made of glass, for example. A reflective coating 26 is provided on a portion of the interior side of the discharge vessel 21, and is covered by a phosphor layer 22. The reflective coating 26 is made of aluminum oxide, for example, which reflects light in both the ultraviolet and visible spectrums. A coil 23*a* is disposed in a cavity portion of the discharge vessel 21. A ballast circuit for supplying high frequency alternating current to the coil 23*a* is provided within a case 25. The discharge vessel 21 is supported by the case 25, and is configured so that an alternating magnetic field is generated from the coil 23*a* due to the high frequency alternating current from the ballast circuit. It should be noted that a lamp base 27 is attached to a portion (bottom portion) of the case 25, and is linked to a commercial power source and connected to the ballast circuit.

The operation of the electrodeless discharge lamp shown in FIG. 3 is described next.

First, an alternating magnetic field is generated within the discharge vessel 21 from the coil 23*a* due to the high frequency alternating current that is supplied from the ballast circuit through the coil 23*a*. An alternating electric field that cancels out this alternating magnetic field is generated in the discharge vessel 21. That is, an electromagnetic field is generated within the discharge vessel 21. Due to the generated alternating electric field, the mercury and the rare gas in the discharge vessel 21 become excited due to repeated collision motion and form a plasma within the discharge vessel 21, and ultraviolet light is radiated from the plasma. The portion of the radiated ultraviolet light that arrives at the phosphor layer 22 applied other than at the cavity portion of the discharge vessel 21 is converted into visible light by the phosphor layer 22 and emanates directly to the outside. Light that is converted into visible light by the phosphor layer 22 applied to the cavity portion of the discharge vessel 21 arrives at the reflective coating 26, is reflected by the reflective coating 26 and passes through the phosphor layer 22 of the cavity portion, travels through the discharge plasma, and then passes through the phosphor layer 22 other than at the cavity portion of the discharge vessel 21 and emanates to the outside. That is, with this configuration, the visible light generated by the phosphor layer 22 of the cavity portion emanates to the outside, and thus usage efficiency of the light is improved.

The reflective coating 26 that is used in conventional electrodeless discharge lamps is formed by applying a solution of titanium oxide or aluminum oxide powder onto the discharge space side of the cavity portion of the discharge vessel 21. Then, after the reflective coating 26 is applied, the phosphor layer 22 is applied thereon. Thus, any irregularities in the application of the reflective coating 26 result in even larger irregularities, that is, variations in the coating thickness, in the applied phosphor layer 22. The phosphor layer 22 is formed by rare earth phosphor and halophosphate phosphor, and in combinations of these phosphors, there is a need for an ideal layer thickness with respect to the light extraction efficiency. The light extraction efficiency drops if the thickness of the phosphor layer is too thin or too thick. Thus, during the manufacturing process, the viscosity and the relative weight, for example, of the applied solution are adjusted so as to achieve the optimal layer thickness required for the phosphor combination. However, if the surface of the reflective coating 26 on which it is applied is uneven, then the phosphor layer cannot be provided at a uniform thickness through such means of adjustment, and this is a problem because the light extraction efficiency is reduced. Also, because the total coating thickness of the two-layered portion (layer of the reflective coating 26 and the phosphor layer 22) is thick, the strength of the coating is reduced, and this is a problem because the coating may come loose due to minor impacts.

SUMMARY OF THE INVENTION

In light of the problems mentioned above, it is an object of the present invention to provide a self-ballasted electrodeless discharge lamp and an electrodeless discharge lamp operation device that efficiently and effectively reflects and utilizes at least one of visible light and infrared light radiated to the cavity portion without the provision of the reflective coating 26 on the discharge space side of the cavity portion in the discharge vessel 21.

A first self-ballasted electrodeless discharge lamp according to the invention is provided with a discharge vessel filled with discharge gas, the discharge vessel having a cavity portion, a coil inserted into the cavity portion of the discharge vessel, a ballast circuit for supplying high frequency power to the coil, and a lamp base that is electrically connected to the ballast circuit, wherein the discharge vessel, the coil, the ballast circuit, and the lamp base are configured as a single unit, and a reflective tape for reflecting light that is radiated from the discharge gas and emitted from the inside of the discharge vessel to its cavity portion side is wound around the coil.

It is preferable that the reflective tape reflects at least one of infrared light and visible light.

It is further preferable that the reflective tape reflects visible light.

It is also preferable that a tube-shaped bobbin around which the coil is wound is further provided.

It is preferable that a reflective plate for reflecting light that is radiated from the discharge gas is further provided between the discharge vessel and the ballast circuit.

In a preferable embodiment, the reflective plate reflects infrared light or visible light.

In another preferable embodiment, the reflective plate reflects visible light.

It is preferable that the coil is wound around a core made of ferrite.

It is further preferable that the reflective tape is also wound around portions of the core surface where the coil is absent.

It is preferable that a phosphor layer is formed on at least a portion of the surface of the inside of the discharge vessel.

A second self-ballasted electrodeless discharge lamp according to the invention is provided with a discharge vessel filled with discharge gas, the discharge vessel having a cavity portion, a coil inserted into the cavity portion of the discharge vessel, a ballast circuit for supplying high frequency power to the coil, and a lamp base that is electrically connected to the ballast circuit, wherein the discharge vessel, the coil, the ballast circuit, and the lamp base are configured as a single unit, and a reflective coating for reflecting light that is radiated from the discharge gas and emitted from the inside of the discharge vessel to its cavity portion side is formed on a surface of a metal wire forming the coil.

A third self-ballasted electrodeless discharge lamp according to the invention is provided with a discharge vessel filled with discharge gas, the discharge vessel having a cavity portion, a coil inserted into the cavity portion of the discharge vessel, a ballast circuit for supplying high frequency power to the coil, and a lamp base that is electrically connected to the ballast circuit, wherein the discharge vessel, the coil, the ballast circuit, and the lamp base are configured as a single unit, and a reflective layer for reflecting light that is radiated from the discharge gas and emitted from the inside of the discharge vessel to its cavity portion side is formed on a surface of the cavity portion that is in opposition to the coil.

An electrodeless discharge lamp operating device according to the invention is provided with a discharge vessel filled with discharge gas, the discharge vessel having a cavity portion, a coil inserted into the cavity portion for generating an electromagnetic field, a ballast circuit for supplying high frequency power to the coil, and a reflection means provided between the discharge vessel and the coil for reflecting light that is radiated from the discharge gas that has discharged due to the electromagnetic field.

It is preferable that the reflection means is selected from a group consisting of a reflective tape, a reflective coating formed on a surface of a metal wire that forms the coil, a reflective layer that is formed on a surface of the cavity portion that is in opposition to the coil, a reflective plate provided between the discharge vessel and the ballast circuit, and a reflective layer formed on the surface of the coil.

It is also possible that a self-ballasted electrodeless discharge lamp of the invention is provided with a discharge vessel filled with discharge gas, the discharge vessel having a cavity portion, a coil inserted into the cavity portion of the discharge vessel, a ballast circuit for supplying high frequency power to the coil, and a lamp base that is electrically connected to the ballast circuit, wherein the discharge vessel, the coil, the ballast circuit, and the lamp base are configured as a single unit, and a reflective layer for reflecting light that is radiated from the discharge gas and emitted from inside the discharge vessel to its cavity portion side is formed on a surface of the coil.

DETAILED DESCRIPTION OF THE INVENTION

Figure 1:
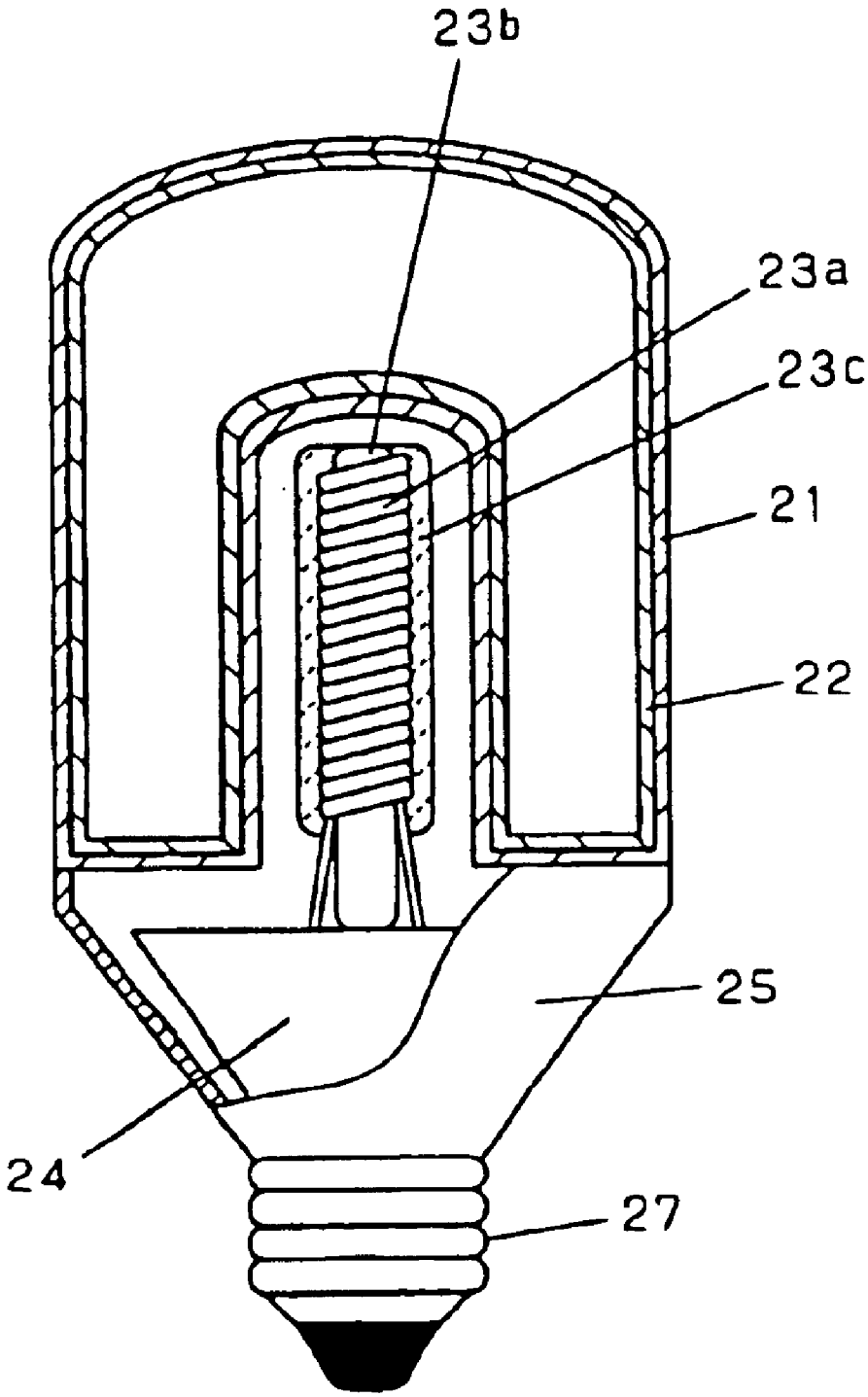
FIG. 1 schematically shows the self-ballasted electrodeless discharge lamp according to an embodiment of the present invention.

FIG. 1 schematically shows the configuration of a self-ballasted electrodeless discharge lamp according to an embodiment of the present invention. The self-ballasted electrodeless discharge lamp is provided with a discharge vessel 21 filled with discharge gas, the discharge vessel 21 having a cavity portion, a coil 23*a* inserted into the cavity portion of the discharge vessel 21, a ballast circuit 24 for supplying high frequency power to the coil 23*a*, and a lamp base 27 that is electrically connected to the ballast circuit 24. The discharge vessel 21, the coil 23*a*, the ballast circuit 24, and the lamp base 27 are formed into a single unit. A reflective tape 23*c* is wound around the coil 23*a*, and reflects the light that is radiated from the discharge gas and emitted from the inside of the discharge vessel 21 to its cavity portion side.

To provide a more detailed description, the self-ballasted electrodeless discharge lamp of this embodiment has a transparent discharge vessel 21 that is provided with a cavity portion. The discharge vessel 21 is made of soda-lime glass, and has an outer diameter of 65 mm, a height of 62 mm, and a thickness of 0.8 mm. It should be noted that the discharge vessel 21 can also be made of lead glass, borosilicate glass, or quartz glass. A discharge gas (not shown) is filled into the interior of the discharge vessel 21. The discharge gas in this embodiment is 100 Pa of krypton and 5 mg of mercury. It should be noted that the discharge gas is a rare gas, and can be at least one of xenon, argon, krypton, neon, and helium. The discharge gas includes mercury in general, but mercury may be excluded.

A magnetic means (core) 23*b* made of a magnetic material around which the coil 23*a* made of metal wire is wound is provided in the cavity portion of the discharge vessel 21. The magnetic material is ferrite, and the core 23*b* is substantially rod-shaped, with a diameter of 14 mm and a length of 55 mm. The coil 23*a* is a twisted wire made of 60 metal wires each with a diameter of 0.08 mm, and is turned 66 times. Also, a reflection means (here, the reflective tape) 23*c* is provided on the surface of the coil 23*a*.

The coil 23*a* is connected to the ballast circuit 24, and the case 25 is provided enclosing the ballast circuit 24. The ballast circuit 24 is electrically connected to the lamp base 27 that is attached to a portion (bottom portion) of the case 25. The ballast circuit 24 converts the commercial power source input from the lamp base 27 into high frequency alternating current, and supplies this to the coil 23*a*. Due to the alternating current that is input to the coil 23*a*, an alternating magnetic field is generated from the coil 23*a* and the core 23*b*, and this alternating magnetic field creates an alternating electric field inside the discharge vessel 21. Then, the discharge gas is discharged as a consequence of this alternating electric field. That is, the discharge gas is discharged due to the electromagnetic field that is generated within the discharge vessel 21. It should be noted that the case 25 is made of PBT (polybutylene terephthalate) and supports the discharge vessel 21.

The following is a description of the frequency of the alternating current that is supplied to the coil 23*a* by the ballast circuit 24. In this embodiment, the frequency of the alternating current supplied by the ballast circuit 24 is in a relatively low frequency region of 1 MHz or less (for example, 50 to 500 kHz). The reason why a frequency in this low frequency region is employed is as follows. First, in the case of operation in a relatively high frequency region such as several MHz or more, the noise filter for suppressing line noise generated from the ballast circuit 24 becomes large, and this increases the volume of the ballast circuit 24. Also, when high frequency noise is radiated or propagated from the lamp, an expensive shield must be provided and used in order to meet the very stringent legal regulations placed on high frequency noise, and this becomes a major obstacle in reducing costs. On the other hand, in the case of operation in a frequency range about 50 kHz to 1 MHz, the inexpensive, common components that are employed as the electronic components in ordinary electronic devices can be employed as the parts making up the ballast circuit 24, and moreover parts with small dimensions can be used. This is extremely advantageous because both cost and size can be reduced. The self-ballasted electrodeless discharge lamp of this embodiment is not limited to operation at 1 MHz or less, and is also capable of operating in a frequency range of several MHz or more, for example.

Also, in place of the reflective tape 23*c*, a reflection means can be provided on the surface of the cavity portion that is in opposition to the coil 23*a* (interior surface), but it is preferably provided on the surface of the coil 23*a* or between the cavity portion and the coil 23*a*. The reason for this is that if a reflection means is provided on the interior surface of the cavity portion, then the corner portion of the tip of the coil 23*a* may scratch the reflection means and thereby damage it when the coil 23*a* is inserted into the cavity portion. Also, when highly reflective particles such as aluminum oxide are employed as the reflection means, they are applied and sintered to the interior wall of the cavity portion to form the reflection means, however, it is difficult to uniformly apply the particles to the interior wall of the cavity portion, and it is also difficult to sufficiently sinter them. As a consequence, portions of the reflection means may fall off due to minor impacts.

A three wavelength phosphor layer 22 made of a red phosphor YOX ($Y_2O_3$:$Eu^{3+}$), a green phosphor LAP ($LaPO_4$:$Ce^{3+}$, $Tb^{3+}$), and a blue phosphor BAT ($BaMg_2Al_{16}O_{27}$:$Eu^{2+}$) is applied to the inner surface of the discharge vessel 21. Ultraviolet light radiated from the discharge gas within the discharge vessel 21 is converted into visible light by the phosphor layer 22. The thickness of the phosphor layer 22 is for example about 50 $\mu$m. Also, a protective coating for preventing deterioration of the phosphor can be applied between the discharge vessel 21 and the phosphor layer 22.

It should be noted that the "exterior wall" of the discharge vessel 21 means the side from which the light emanates, and because the cavity portion is not located on the side from which the light emanates, the cavity portion is not included in the exterior wall of the discharge vessel 21.

Next, the operation of the self-ballasted electrodeless discharge lamp configured as shown in FIG. 1 is described.

First, an alternating magnetic field is generated from the coil 23*a* and the core 23*b* due to the alternating current that is supplied to the coil 23*a* from the ballast circuit 24. The generated alternating magnetic field creates an alternating electric field within the discharge vessel 21, and due to the alternating electric field, the luminous substance (discharge gas) within the discharge vessel 21 is excited due to repeated acceleration and collision, and generates ultraviolet light. The ultraviolet light that is generated is converted into visible light by the phosphor layer 22, and a portion thereof is emitted outside the exterior wall of the discharge vessel 21. Another portion thereof arrives at the reflective tape 23*c* disposed within the cavity portion, and light in the visible spectrum is reflected by the reflective tape 23*c* and returned to the interior of the discharge vessel 21, passes through the phosphor layer 22 on the exterior wall, and is emitted to the outside.

That is, the electrodeless discharge lamp of this embodiment can be given as an electrodeless discharge lamp operating device provided with the discharge vessel 21 filled with discharge gas, the discharge vessel 21 having a cavity portion, the coil 23*a* inserted into the cavity portion that generates an electromagnetic field, the ballast circuit 24 for supplying high frequency power to the coil 23*a*, and a reflection means (reflective tape 23*c*) provided between the discharge vessel 21 and the coil 23*a* for reflecting the light that is radiated from the discharge gas that is discharged due to the electromagnetic field.

Hereinafter, the present embodiment is described in greater detail.

The reflective tape 23*c* is further provided with a means for fixing the coil 23*a* to the core 23*b*. For example, the coil 23*a* can be fastened to the core 23*b* by using an adhesive thin film tape such as a fluoroplastic or polyimide resin with a high thermal resistance as the base portion of the reflective tape 23*c*. The reflective tape 23*c* has the same width as the length of the core 23*b*, and has been adhered so that it covers the entire surface of the coil 23*a* and the surface of the core 23*b* where the coil 23*a* is not wound. It should be noted that when the reflective tape is narrow and in the shape of a band, it is also possible to wind the reflective tape in a spiral around the coil 23*a* and the surface of the core 23*b* so that it completely covers the surface of the coil 23*a* and the surface of the core 23*b* where the coil 23*a* is not wound. By thus fixing the coil 23*a* to the core 23*b*, the coil 23*a* can be prevented from becoming loose or displaced, a constant current density can be formed along the axis of the core 23*b*, and stable electromagnetic properties can be obtained. This thin film tape can be provided with reflectivity by applying highly reflective particles or depositing aluminum, for example, to form a reflective layer. As an example of highly reflective particles, it is possible to use aluminum oxide or magnesium oxide or the like, which reflect ultraviolet and visible light. It is also possible to use barium sulfate or the like as the highly reflective particles for reflecting visible light. Additionally, when a multi-layer interference film (alternating layers of titanium oxide, which has a high refractive index, and silicon oxide, which has a low refractive index) that reflects infrared light is formed on the thin film tape, infrared light can be reflected.

In the following description, the reflective tape 23*c* is a thin film tape to which highly reflective particles that reflect light in the ultraviolet and visible spectrums have been applied.

Ultraviolet light that is generated within the discharge vessel 21 is converted into visible light by the phosphor 22. A portion of that visible light is emitted out the exterior wall of the discharge vessel 21, and another portion thereof arrives at the reflective tape 23*c* provided in the cavity portion, is reflected and passes through the phosphor 22 provided in the cavity portion, returns to inside the discharge vessel 21, and then passes through the phosphor 22 of the exterior wall and is emitted to the outside.

Table 1 shows the results of a comparison of the emission efficiency of a self-ballasted electrodeless discharge lamp A that does not have a reflection means (comparative example 1), a self-ballasted electrodeless discharge lamp B that has a reflection means (a microparticle reflective coating made of aluminum oxide microparticles) over the entire surface of the cavity portion on the discharge space side in the discharge vessel 21 (comparative example 2), and the self-ballasted electrodeless discharge lamp C according to the present embodiment having the reflective tape 23*c* (thin film tape) on the surface of the coil 23*a*. The self-ballasted electrodeless discharge lamp A is the self-ballasted electrodeless discharge lamp according to the present embodiment that is described above and shown in FIG. 1 except that it lacks only the reflective tape 23*c*. The self-ballasted electrodeless discharge lamp B is the self-ballasted electrodeless discharge lamp according to the present embodiment that is described above and shown in FIG. 1, except that the reflective tape 23*c* has been removed and a microparticle reflective coating (thickness of about 1 $\mu$m) made of aluminum oxide microparticles is formed between the surface of the cavity portion on the discharge space side in the discharge vessel 21 and the phosphor layer 22. The self-ballasted electrodeless discharge lamp C is the self-ballasted electrodeless discharge lamp according to the present embodiment that is described above and shown in FIG. 1. The "ratio to B" is the ratio of the total luminous flux of each self-ballasted electrodeless discharge lamp when the total luminous flux of the self-ballasted electrodeless discharge lamp B is 100%. It should be noted that the power consumption of the lamps is 12W.

TABLE 1

| | Electrodeless Discharge Lamp A (comparative example 1) | Electrodeless Discharge Lamp B (comparative example 2) | Electrodeless Discharge Lamp C (embodiment of the invention) |
|---|---|---|---|
| Total Luminous Flux (lm) | 705 | 750 | 760 |
| Ratio to B (%) | 94.0 | 100.0 | 101.3 |

From Table 1 we can see that there is an approximately 6% difference in emission efficiency depending on whether there is a reflection means (difference between lamp A and lamp B). It was also found that there is an approximately 1.3% improvement in emission efficiency in the self-ballasted electrodeless discharge lamp C, which has the reflective tape 23*c* on the coil 23*a*, over the self-ballasted electrodeless discharge lamp B, which has a microparticle reflective coating as the reflection means on the surface of the cavity portion on the discharge space side in the discharge vessel 21. The reason for this is as follows. With the conventional self-ballasted electrodeless discharge lamp B having a microparticle reflective coating within the discharge vessel 21, the phosphor layer 22 is applied after the microparticle reflective coating is applied. When the phosphor layer 22 is applied, because unevenness remains in the surface of the microparticle reflective coating, the coating thickness of the second layer, the phosphor layer 22, cannot be provided uniformly and thus cannot be adjusted to the optimal coating thickness at which the emission efficiency is highest. As a consequence, loss of light occurs.

The present embodiment has the reflective tape 23*c*, that is, the reflection means, on the outside rather than the inside of the discharge vessel 21, so that the optimal thickness of the phosphor layer 22 can be provided easily, a loss of light due to varying thickness of the phosphor layer 22 can be reduced, and the light extraction efficiency can be further improved. Also, because it does not have a two-layered (microparticle reflective coating and phosphor layer 22) portion on the discharge space side of the cavity portion of the discharge vessel 21, the total thickness of this portion can be provided thin and the coating strength can be increased.

An alternate example in which a reflective coating that reflects infrared light is applied is described next.

Due to the alternating current that is supplied to the coil 23*a* from the ballast circuit 24, an alternating magnetic field is generated from the coil 23*a* and the core 23*b*, and this generates an alternating electric field in the discharge vessel 21. The emission substance (discharge gas) within the discharge vessel 21 is repeatedly accelerated and collided due to this alternating electric field and a plasma is created. In the above operation, the plasma has an extremely elevated temperature, and heat transferred from the plasma raises the coil 23*a* and the core 23*b* to very high temperatures that may exceed their ideal temperature. In particular, because the core 23*b* includes a magnetic material, if the temperature exceeds its Curie temperature, then it is conceivable that the inductance made by the coil 23*a* and the core 23*b* will be reduced and the magnetic field will no longer be created. Moreover, if the coil 23*a* exceeds a temperature it can resist, then dielectric breakdown caused by the coil 23*a* film peeling away is possible. Thus, to maintain the discharge of a self-ballasted electrodeless discharge lamp, the elevation in temperature of the coil 23*a* and the core 23*b* due to the transfer of heat from the plasma must be lowered.

In this alternate example, an infrared light reflective coating such as a multi-layered interference coating is applied to the surface of the coil 23*a* in order to return the heat created from the plasma back into the discharge vessel 21 and release the heat from its exterior wall. Thus, with a simple configuration, a rise in temperature of the coil 23*a* and the core 23*b* can be effectively suppressed.

It should be noted that in this embodiment, the reflective tape 23*c* is a thin film tape that is adhesive on one side so as to serve as the means for fixing the coil 23*a* to the core 23*b*, and on its other side is provided with a means for reflecting ultraviolet light and visible light or for reflecting infrared light. Consequently, after liquid that has adhesiveness is applied to the opposite surface of a film onto which a reflective coating has already been deposited, the coil 23*a* can be fixed to the core 23*b* by this film, so that the reflective layer can be formed easily without having to apply a reflective coating to a curved surface such as the coil.

If the coil 23*a* is fixed to the core 23*b*, then in place of the reflective tape 23*c* it is possible to employ a reflective layer where reflective microparticles are applied directly onto the coil 23*a*. Also, the reflection means can be provided at the same time that the coil 23*a* is disposed around the core 23*b* by forming a reflective coating that has reflectivity onto the surface of the metal wire that forms the coil 23*a* in advance.

In the example shown, a reflection means such as the reflective tape 23*c* is closely adhered to the coil 23*a*, but the reflection means does not necessarily have to be closely adhered to the coil 23*a*, and can also be between the coil 23*a* and the cavity portion of the discharge vessel 21, or for example can be in the shape of a tube that covers the coil 23*a*.

Further, if there is a core 23*b*, then by forming a reflection means such as the reflective tape 23*c* also on the surface of portion of the core 23*b* where the coil 23*a* is not wound, it is possible to further improve the light extraction efficiency.

Next, a modified example of the present embodiment is described.

Figure 2:
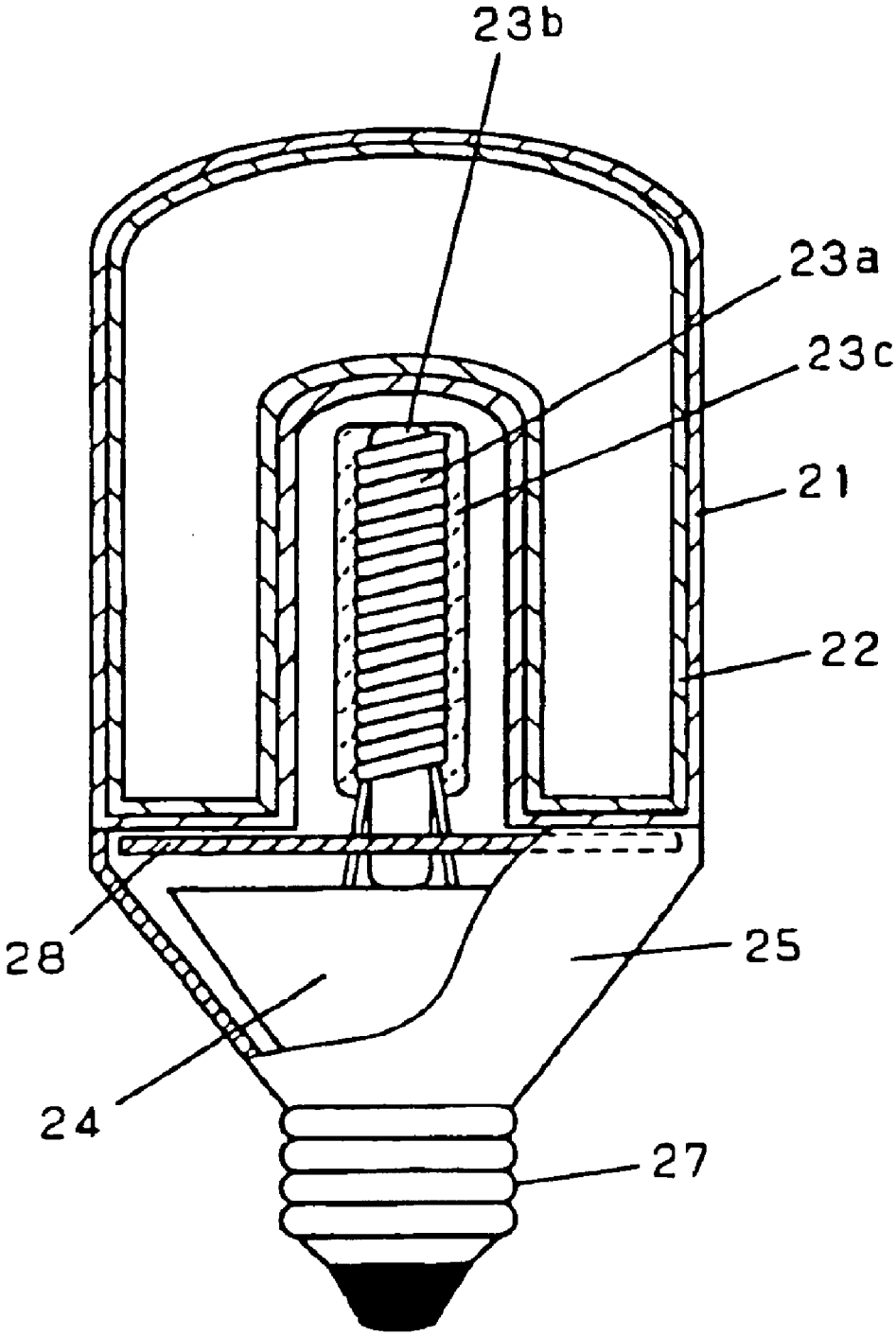
FIG. 2 schematically shows the self-ballasted electrodeless discharge lamp according to the Modified Example 1 of the embodiment of the present invention.
Figure 3:
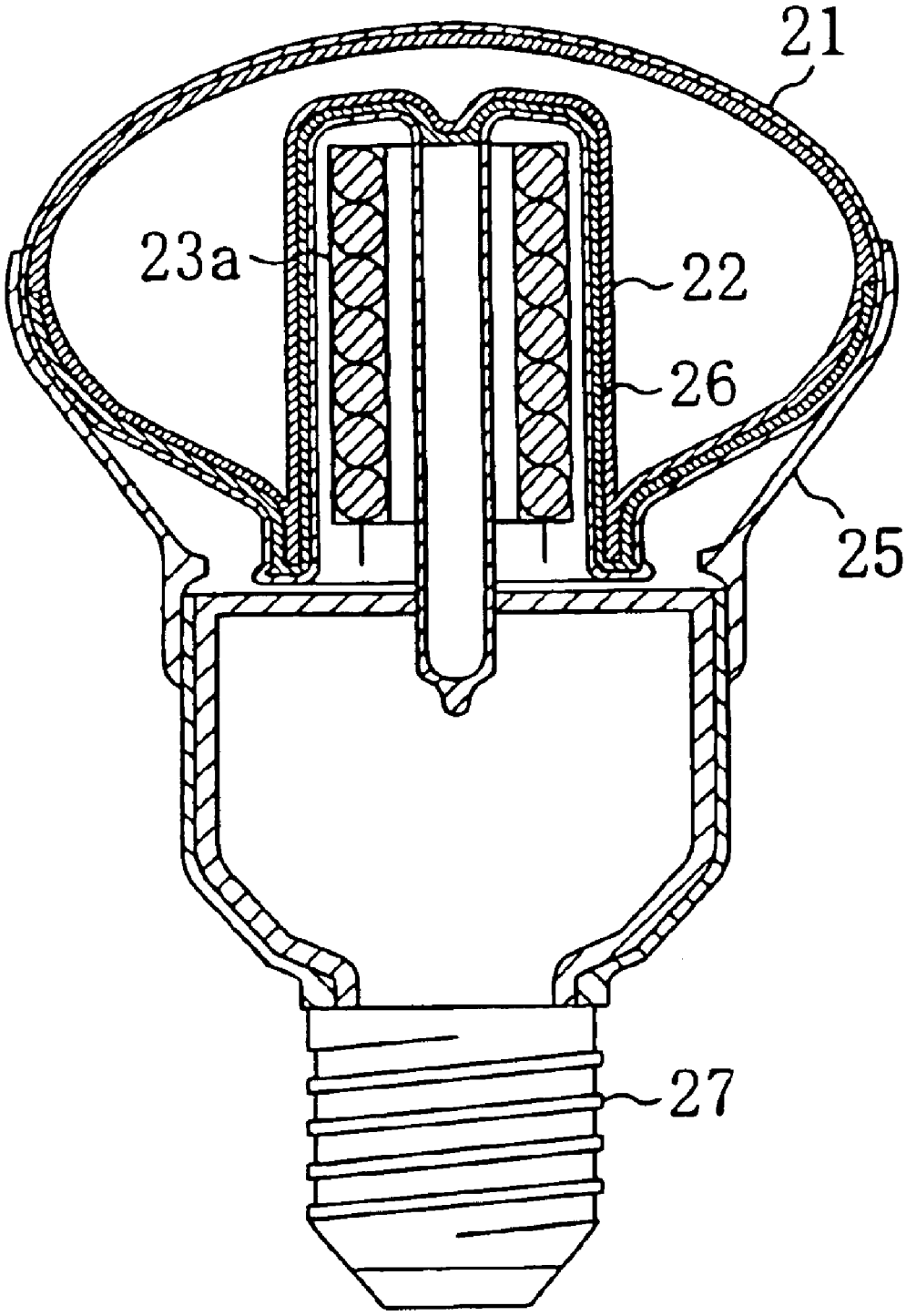
FIG. 3 PRIOR ART
FIG. 3 schematically shows a conventional electrodeless discharge lamp.

In the Modified Example 1 shown in FIG. 2, a reflective plate 28 that reflects the light that is radiated from the discharge gas is further provided between the discharge vessel 21 and the ballast circuit 24 of the lamp embodied as in FIG. 1, and reflects at least one of light in the visible and infrared spectrums. The reflective plate 28 is in the shape of a disk. It should be noted that as long as the reflective plate 28 can reflect at least one of visible and infrared light, then it can be a plate that is quadrangular, pentagonal, or hexagonal, for example, or a plate of a shape that encloses the ballast circuit 24.

Ultraviolet light that is generated within the discharge vessel 21 is converted into visible light by the phosphor 22 and a portion thereof is emitted outside the exterior wall of the discharge vessel 21, while another portion thereof arrives at the reflective tape 23*c* of the coil 23*a* provided in the cavity portion and is reflected, passes through the phosphor 22 and is returned into the discharge vessel 21, and passes through the phosphor 22 of the exterior wall and is emitted as light to the outside. Moreover, a portion of the visible light arrives at the reflective plate 28 and is reflected, passes through the phosphor 22 and is returned into the discharge vessel 21, and then passes through the phosphor 22 of the exterior wall and is emitted as light to the outside.

Table 2 shows the results of a comparison of the emission efficiency of the self-ballasted electrodeless discharge lamp C, which has the reflection means (reflective tape) 23*c* on the surface of the coil 23*a*, and a self-ballasted electrodeless discharge lamp D, which has the reflection means (reflective tape) 23*c* on the surface of the coil 23*a* and also has the reflective plate 28. The self-ballasted electrodeless discharge lamp C is the above lamp shown in FIG. 1. The self-ballasted electrodeless discharge lamp D is the above lamp shown in FIG. 2, and employs a disk-shaped reflective plate 28 of a 50 mm diameter and 2 mm thickness, in which microparticles of aluminum oxide have been applied to its surface on the discharge vessel 21 side. Also, the "ratio to C" is the ratio of the total luminous flux of the self-ballasted electrodeless discharge lamp D when the total luminous flux of the self-ballasted electrodeless discharge lamp C is given as 100%.

TABLE 2

| | Electrodeless Discharge Lamp C (embodiment of the invention) | Electrodeless Discharge Lamp D (modified example 1) |
|---|---|---|
| Total Luminous Flux (lm) | 760 | 776 |
| Ratio to C (%) | 100.0 | 102.1 |

It is clear from Table 2 that there is an approximately 2.1% increase in emission efficiency with the self-ballasted electrodeless discharge lamp D, which has the reflective plate 28, over the self-ballasted electrodeless discharge lamp C. By providing not only the reflective tape 23*c* but also the reflective plate 28, the visible light that is radiated other than to the exterior wall of the discharge vessel 21 is reflected, so that the light extraction efficiency can be further improved.

Figure 4:
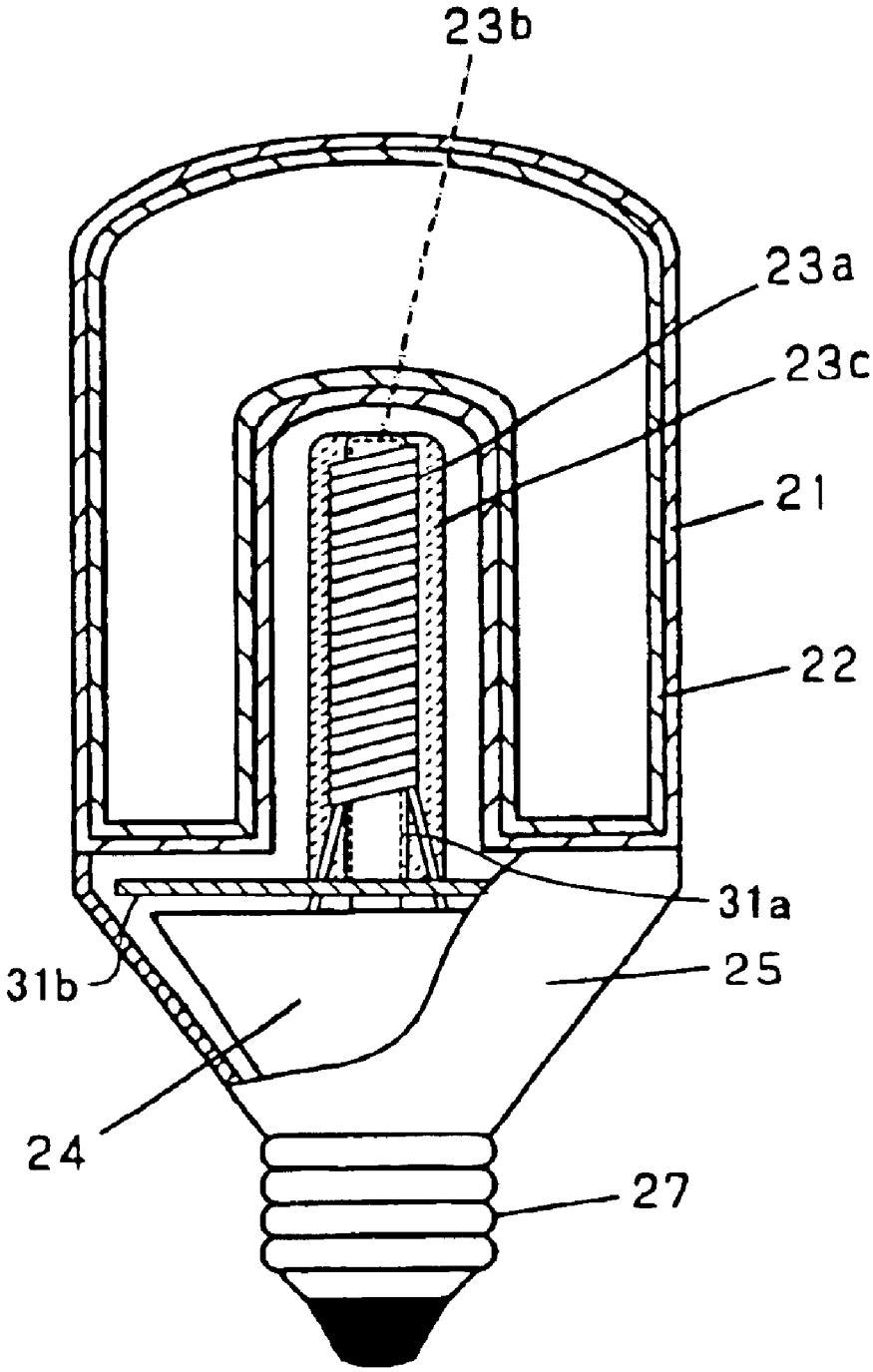
FIG. 4 schematically shows the self-ballasted electrodeless discharge lamp according to the Modified Example 2 of the embodiment of the present invention.

Next, the Modified Example 2 shown in FIG. 4 is described.

In addition to the configuration of the present embodiment, the Modified Example 2 is further provided with a tube-shaped bobbin 31*a* around which the coil 23*a* is wound. The core 23*b* made of ferrite is inserted into the bobbin 31*a*. Also, a disk-shaped base portion 31*b* is attached to the end portion of the bobbin 31*a* on its lamp base 27 side. That is, it has the base portion 31*b* that extends from an end of the tubular coil shaft portion perpendicularly to its central axis. A reflection means (reflective tape) 23*c* has also been attached to the surfaces of the bobbin 31*a*, and the coil 23*a* in opposition to the discharge vessel 21. On one surface of the reflection means 23*c* aluminum oxide particles have been applied, and on the opposite surface an adhesive agent has been applied. Like the Modified Example 1, the Modified Example 2 is capable of increasing the light extraction efficiency over that of the self-ballasted electrodeless discharge lamp C, and can be assembled easily. It should be noted that it is also possible to provide a portion of the base portion 31*b* integrally with a material identical to that of the bobbin 31*a*, and moreover it is also possible to provide a reflection means (for example, the reflective tape 23*c*) on the surface of the base portion 31*b* that is in opposition to the discharge vessel 21.

Figure 5:
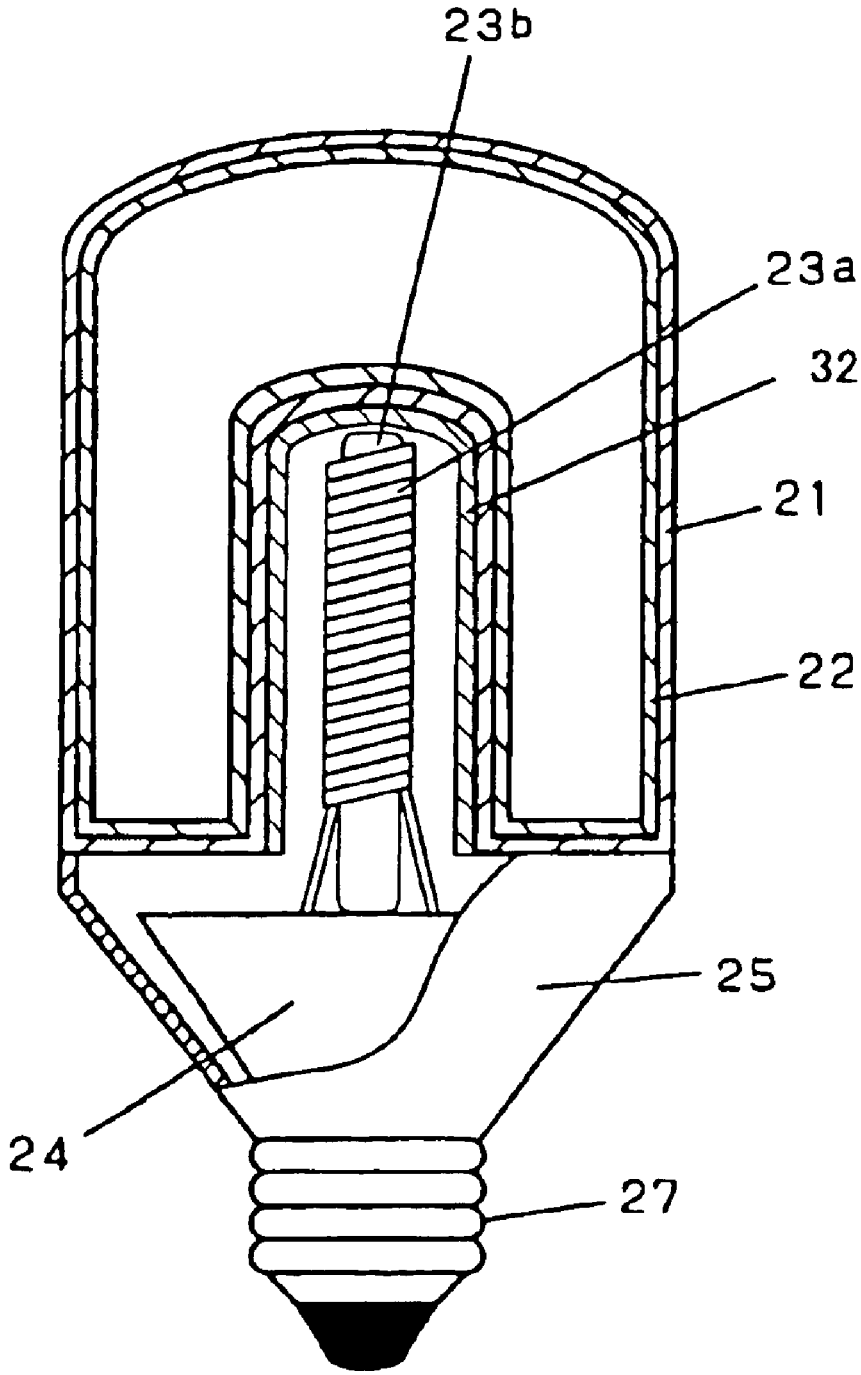
FIG. 5 schematically shows the self-ballasted electrodeless discharge lamp according to the Modified Example 3 of the embodiment of the present invention.

A Modified Example 3 shown in FIG. 5 is described next.

The Modified Example 3 is a self-ballasted electrodeless discharge lamp in which a reflective layer 32 has been formed on the surface of the cavity portion of the discharge vessel 21 that is in opposition to the coil 23*a*. The reflective layer 32 is formed by applying highly reflective particles of aluminum oxide, for example, to the inside surface of the cavity portion of the discharge vessel 21. Like the self-ballasted electrodeless discharge lamp embodied as in FIG. 1, Modified Example 3 achieves an improvement in emission efficiency compared to the self-ballasted electrodeless discharge lamps A and B.

The self-ballasted electrodeless discharge lamp of the present invention is provided with a discharge vessel filled with discharge gas, the discharge vessel having a cavity portion, a coil inserted into the cavity portion of the discharge vessel, a ballast circuit for supplying high frequency power to the coil, and a lamp base that is electrically connected to the ballast circuit, and the discharge vessel, the coil, the ballast circuit, and the lamp base are configured as a single unit. By providing a reflection means such as a reflective tape between the discharge vessel and the coil, it is possible to reflect at least one of visible light and infrared light radiated into the cavity portion without providing a reflective coating on the discharge space side of the cavity portion of the discharge vessel, and a reflective coating does not have to be formed on the surface of the cavity portion on the interior side of the discharge vessel, so that the phosphor layer can be kept from having an unsuitable coating thickness due to unevenness in the reflective coating, and the light extraction efficiency can be improved.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A self-ballasted electrodeless discharge lamp comprising:

a discharge vessel filled with discharge gas, the discharge vessel having a cavity portion;

a coil inserted into the cavity portion of the discharge vessel;

a ballast circuit for supplying high frequency power to the coil; and a lamp base that is electrically connected to the ballast circuit;

wherein the discharge vessel, the coil, the ballast circuit, and the lamp base are configured as a single unit, and wherein a reflective tape for reflecting light that is radiated from the discharge gas and emitted from the inside of the discharge vessel to its cavity portion side is wound around the coil.

2. The self-ballasted electrodeless discharge lamp according to claim 1, wherein the reflective tape reflects at least one of infrared light and visible light.

3. The self-ballasted electrodeless discharge lamp according to claim 1, wherein the reflective tape reflects visible light.

4. The self-ballasted electrodeless discharge lamp according to claim 1, further comprising a tube-shaped bobbin around which the coil is wound.

5. The self-ballasted electrodeless discharge lamp according to claim 1, further comprising a reflective plate between the discharge vessel and the ballast circuit for reflecting light that is radiated from the discharge gas.

6. The self-ballasted electrodeless discharge lamp according to claim 1, wherein the coil is wound around a core made of ferrite.

7. The self-ballasted electrodeless discharge lamp according to claim 6, wherein the reflective tape is also wound around portions of the core surface where the coil is absent.

8. The self-ballasted electrodeless discharge lamp according to claim 1, wherein a phosphor layer is formed on at least a portion of the surface of the inside of the discharge vessel.

9. A self-ballasted electrodeless discharge lamp comprising:

a discharge vessel filled with discharge gas, the discharge vessel having a cavity portion;

a coil inserted into the cavity portion of the discharge vessel;

a ballast circuit for supplying high frequency power to the coil; and a lamp base that is electrically connected to the ballast circuit;

wherein the discharge vessel, the coil, the ballast circuit, and the lamp base are configured as a single unit, and wherein a reflective coating for reflecting light that is radiated from the discharge gas and emitted from the inside of the discharge vessel to its cavity portion side is formed on a surface of a metal wire forming the coil.

10. A self-ballasted electrodeless discharge lamp comprising:

a discharge vessel filled with discharge gas, the discharge vessel having a cavity portion;

a coil inserted into the cavity portion of the discharge vessel;

a ballast circuit for supplying high frequency power to the coil; and a lamp base that is electrically connected to the ballast circuit;

wherein the discharge vessel, the coil, the ballast circuit, and the lamp base are configured as a single unit, and wherein a reflective layer for reflecting light that is radiated from the discharge gas and emitted from the inside of the discharge vessel to its cavity portion side is formed on a surface of the cavity portion that is in opposition to the coil.

11. An electrodeless discharge lamp operating device comprising:

a discharge vessel filled with discharge gas, the discharge vessel having a cavity portion;

a coil inserted into the cavity portion for generating an electromagnetic field;

a ballast circuit for supplying high frequency power to the coil; and a reflection means provided between the discharge vessel and the coil for reflecting light that is radiated from the discharge gas that has discharged due to the electromagnetic field.

12. The electrodeless discharge lamp operating device according to claim 11, wherein the reflection means is selected from a group consisting of a reflective tape, a reflective coating formed on a surface of a metal wire that forms the coil, a reflective layer that is formed on a surface of the cavity portion that is in opposition to the coil, a reflective plate provided between the discharge vessel and the ballast circuit, and a reflective layer formed on the surface of the coil.

* * * * *

UNITED STATES PATENT AND TRADEMARK OFFICE

CERTIFICATE OF CORRECTION

PATENT NO. : 6,809,479 B2
DATED : October 26, 2004
INVENTOR(S) : Yoko Shimomura et al.

It is certified that error appears in the above-identified patent and that said Letters Patent is hereby corrected as shown below:

Column 12,
Line 40, delete "." and substitute therefor
-- ,
wherein the reflection means is provided on an outside surface of the discharge vessel at the cavity portion that is in opposition to the coil. --

Signed and Sealed this

Ninth Day of August, 2005

JON W. DUDAS
*Director of the United States Patent and Trademark Office*